US007093386B1

(12) United States Patent
Vieweg

(10) Patent No.: US 7,093,386 B1
(45) Date of Patent: Aug. 22, 2006

(54) REMOVABLE BASE MAGAZINE SYSTEMS

(76) Inventor: Thomas Vieweg, 777 Mount Ave., Wyandanch, NY (US) 11798

( * ) Notice: Subject to any disclaimer, the term of this patent is extended or adjusted under 35 U.S.C. 154(b) by 38 days.

(21) Appl. No.: 10/939,868

(22) Filed: Sep. 13, 2004

(51) Int. Cl.
*F41A 9/61* (2006.01)

(52) U.S. Cl. ..... 42/7

(58) Field of Classification Search ..... 42/49.01, 42/49.02, 49.1, 50, 6, 7
See application file for complete search history.

(56) References Cited

U.S. PATENT DOCUMENTS 3,377,732 A * 4/1968 Bivens ..... 42/50
4,397,109 A * 8/1983 Pachmayr et al. ..... 42/50
4,495,720 A * 1/1985 Bross ..... 42/7
4,592,160 A * 6/1986 Bross ..... 42/7
4,805,333 A * 2/1989 Doria et al. ..... 42/50
4,831,761 A * 5/1989 Kulakow ..... 42/50
5,666,752 A * 9/1997 Grams ..... 42/49.02
6,481,136 B1 * 11/2002 Fitzpartick ..... 42/50
6,698,127 B1 * 3/2004 Weber ..... 42/71.02
6,748,689 B1 * 6/2004 Fitzpatrick ..... 42/50
6,883,261 B1 * 4/2005 Fitzpatrick ..... 42/50

* cited by examiner

*Primary Examiner*—Stephen M. Johnson
*Assistant Examiner*—Bret Hayes
(74) *Attorney, Agent, or Firm*—Edward P. Dutkiewicz

(57) ABSTRACT

A removable base magazine is in a rectilinear configuration. The magazine has side faces and front and rear faces. The magazine has inwardly flared flanges spaced beneath the lower extent of the side and front and rear faces. A base plate assembly has a base plate and a retainer. The base plate has essentially parallel side edges, a rear edge and a front edge with a circular aperture. The retainer has essentially parallel side edges, a rear edge and a front edge. A cylindrical projection extends downwardly from the bottom face through the circular aperture of the base plate for the coupling there between. The rear and front edges of the retainer are curved upwardly from the base plate. A resilient element within the magazine is adapted to urge bullets within the magazine upwardly toward the barrel.

4 Claims, 4 Drawing Sheets

FIG 1
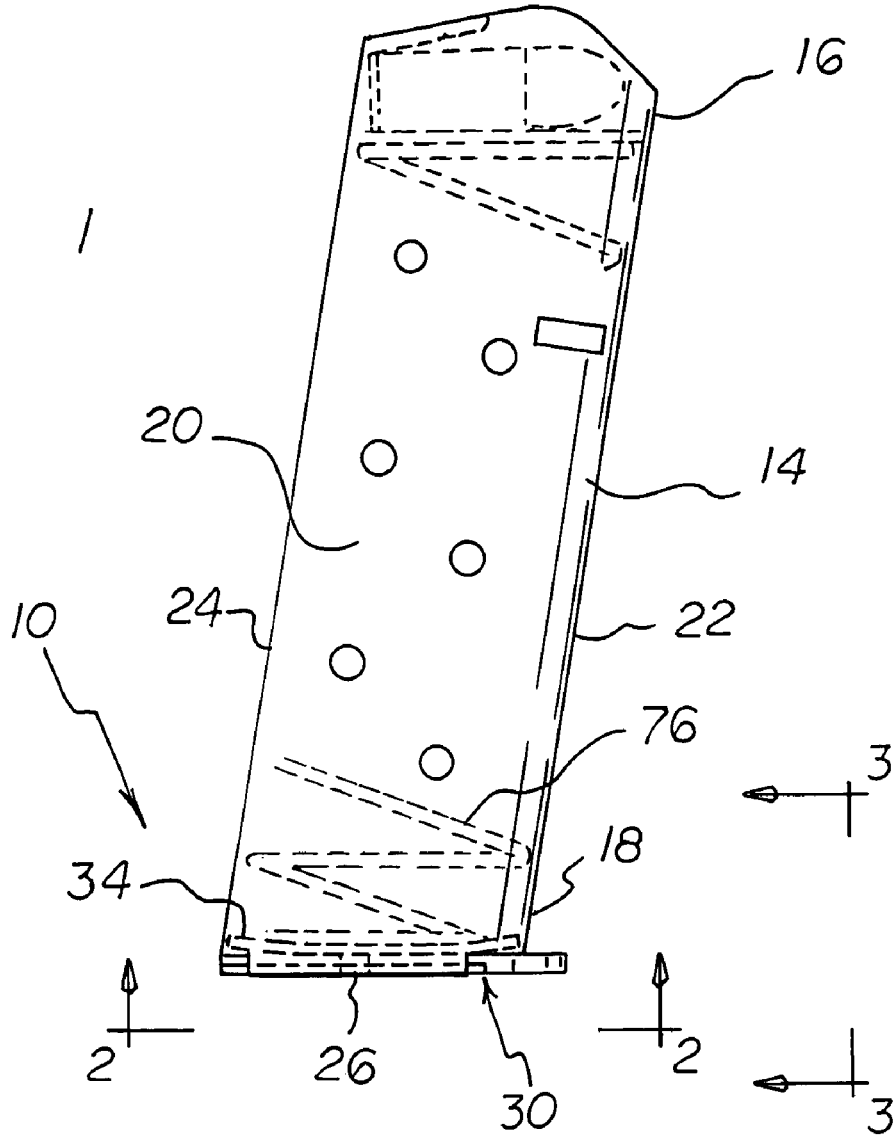
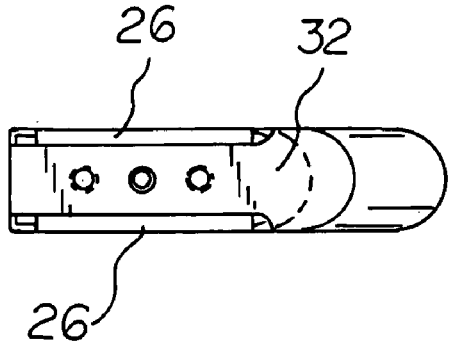
FIG 2

FIG 3
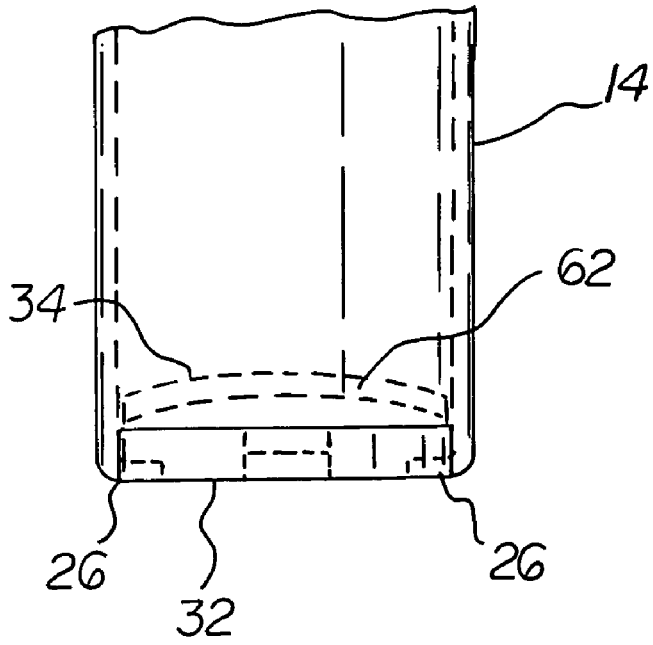
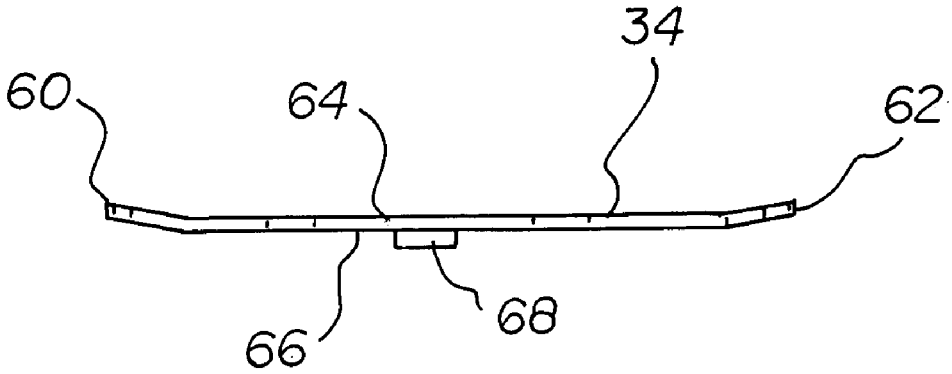
FIG 4

FIG 5
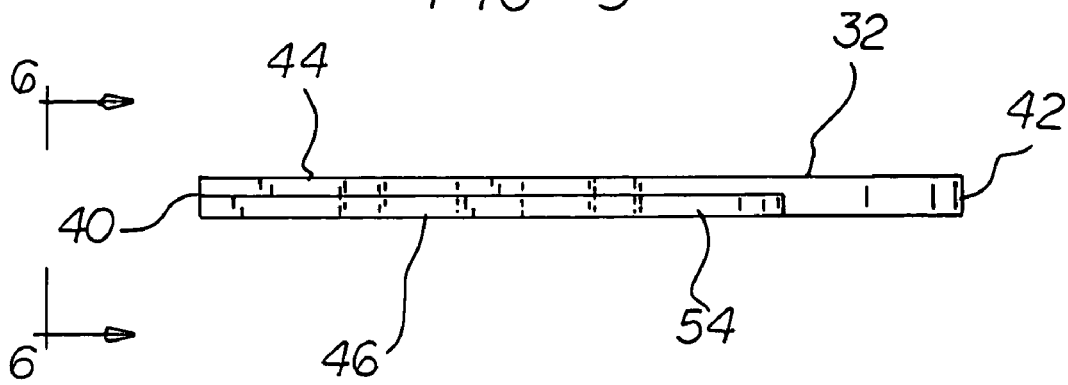
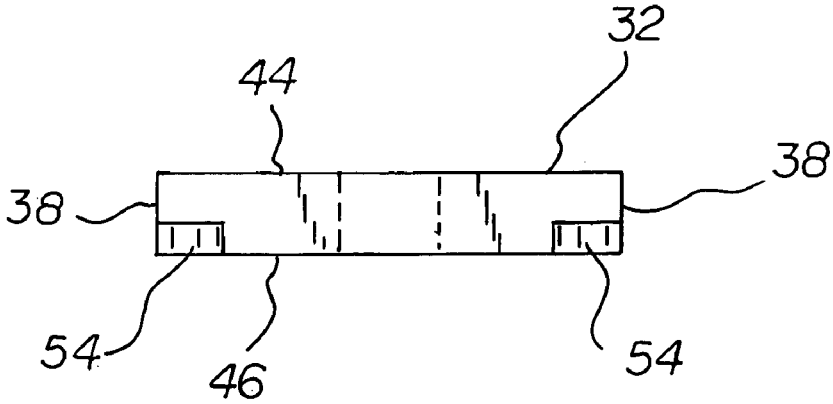
FIG 6

REMOVABLE BASE MAGAZINE SYSTEMS

RELATED APPLICATION

The present application is an improvement over my prior invention set forth in U.S. Pat. No. 6,055,758 issued May 2, 2000, the subject matter of which is incorporated by reference herein.

BACKGROUND OF THE INVENTION

1. Field of the Invention

The present invention relates to a removable base magazine system and more particularly pertains to use with a pistol of the type having a barrel and a trigger and a handle for fully receiving the removable base magazine system.

2. Description of the Prior Art

The use of magazine systems of known designs and configurations is known in the prior art. More specifically, magazine systems of known designs and configurations previously devised and utilized for the purpose of receiving the removable base magazine systems through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,099,595 to Chesnut issued Mar. 31, 1992 relates to a magazine for a firearm. U.S. Pat. No. 5,438,783 to Sniezak issued Aug. 8, 1995 relates to a butt plate assembly for handgun magazines. U.S. Pat. No. 5,526,600 to Chesnut issued Jun. 18, 1996 relates to a cartridge magazine capacity extender. U.S. Pat. No. 5,642,582 to Grams issued Jul. 1, 1997 relates to a base pad for a hand gun magazine. Lastly, U.S. Pat. No. 6,055,758 to Vieweg issued May 2, 2000 relates to a firearm.

While these devices fulfill their respective, particular objectives and requirements, the aforementioned patents do not describe removable base magazine system that allows use with a pistol of the type having a barrell and a trigger and a handle for fully receiving the removable base magazine system.

In this respect, the removable base magazine system according to the present invention substantially departs from the conventional concepts and designs of the prior art, and in doing so provides an apparatus primarily developed for the purpose of use with a pistol, the pistol being of the type having a barrell and a trigger and a handle for fully receiving the removable base magazine system.

Therefore, it can be appreciated that there exists a continuing need for a new and improved removable base magazine system which can be used for use with a pistol of the type having a barrell and a trigger and a handle for fully receiving the removable base magazine system. In this regard, the present invention as described herein substantially fulfills this need.

SUMMARY OF THE INVENTION

In view of the foregoing disadvantages inherent in the known types of magazine systems of known designs and configurations now present in the prior art, the present invention provides an improved removable base magazine system. As such, the general purpose of the present invention, which will be described subsequently in greater detail, is to provide a new and improved removable base magazine system and method which has all the advantages of the prior art and none of the disadvantages.

To attain this, the present invention essentially comprises a removable base magazine. The magazine is in a rectilinear configuration. The magazine has an upper extent. The upper extent is positionable adjacent to a barrel. The magazine has a lower extent. The lower extent is positionable totally within a handle. The magazine also has rectangularly shaped large side faces and rectangularly shaped small front and rear faces. The front and rear faces couple the side faces. Inwardly flared flanges are spaced beneath the lower extent of the side and front and rear faces. The magazine is adapted to receive bullets. The magazine is further adapted to be positioned within the magazine.

A base plate assembly is provided. The base plate assembly has a relatively thick base plate. The base plate has a first thickness of about 0.80 inches. The base plate has a relatively thin retainer. The retainer has a second thickness of about 3/64 inches.

The base plate has a length of about 1.59 inches and a width of about 0.488 inches. The base plate has long essentially parallel side edges. The base plate has a flat rear edge and a semi-circular front edge. The base plate has a top face and a bottom face. A circular aperture is provided in proximity to the center of the base plate. Forward and rearward apertures are provided forwardly and rearwardly of the circular aperture. The base plate also has linear recesses on the bottom face adjacent to the side edges. The linear recesses extending from the rear edge to adjacent to the front edge. The recesses are adapted to receive the flanges of the side faces during operation and use.

The retainer has a length of about 1.32 inches and a width of about 0.483 inches. The retainer has long essentially parallel side edges, a flat rear edge and a semi-circular front edge. The retainer has a top face and a bottom face. A cylindrical projection is provided. The projection has an axial length of about 0.06 inches. The projection extends downwardly from the bottom face through the circular aperture of the base plate for the coupling there between. The retainer has forward and rearward apertures forwardly and rearwardly of the cylindrical projection. The apertures are in axial alignment with the forward and rearward apertures of the base plate during operation and use. The rear edge of the retainer is located forwardly about 0.40 inches from the rear edge of the base plate. The rear and front edges of the retainer are curved upwardly from the base plate. The base plate is positionable above the flanges and beneath the front and rear faces while the retainer is positionable above the base plate between the front and read faces. The base plate and the retainer are preferably fabricated of a rigid metal selected from the class of rigid metals including carbon steel and 410 stainless steel.

Provided last is a resilient element. The resilient element is within the magazine. The resilient element is adapted to urge bullets within the magazine upwardly toward the barrel.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved removable base magazine system which has all of the advantages of the prior art magazine systems of known designs and configurations and none of the disadvantages.

It is another object of the present invention to provide a new and improved removable base magazine system which may be easily and efficiently manufactured and marketed.

It is further object of the present invention to provide a new and improved removable base magazine system which is of durable and reliable constructions.

An even further object of the present invention is to provide a new and improved removable base magazine system which is susceptible of a low cost of manufacture with regard to both materials and labor, and which accordingly is then susceptible of low prices of sale to the consuming public, thereby making such removable base magazine system economically available to the buying public.

Even still another object of the present invention is to provide a removable base magazine system for use with a pistol of the type having a barrell and a trigger and a handle for fully receiving the removable base magazine system.

Lastly, it is an object of the present invention to provide a new and improved removable base magazine is in a rectilinear configuration. The magazine has side faces and front and rear faces. The magazine has inwardly flared flanges spaced beneath the lower extent of the side and front and rear faces. A base plate assembly has a base plate and a retainer. The base plate has essentially parallel side edges, a rear edge and a front edge with a circular aperture. The retainer has essentially parallel side edges, a rear edge and a front edge. A cylindrical projection extends downwardly from the bottom face through the circular aperture of the base plate for the coupling there between. The rear and front edges of the retainer are curved upwardly from the base plate to assist in urging bullets upwardly during operation and use. A resilient element within the magazine is adapted to urge bullets within the magazine upwardly toward the barrel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of the preferred embodiment of the removable base magazine system constructed in accordance with the principles of the present invention.

FIG. 2 is a bottom view of the removable base magazine system taken along line 2—2 of FIG. 1.

FIG. 3 is an enlarged end view taken along line 3—3 of FIG. 1.

FIG. 4 is a side elevational view of the retainer of the prior Figures.

FIG. 5 is a side elevational view of the base plate of the prior Figures.

FIG. 6 is an end view of the base plate taken along line 6—6 of FIG. 5.

The same reference numerals refer to the same parts throughout the various Figures.

DESCRIPTION OF THE PREFERRED EMBODIMENT

Figure 7:
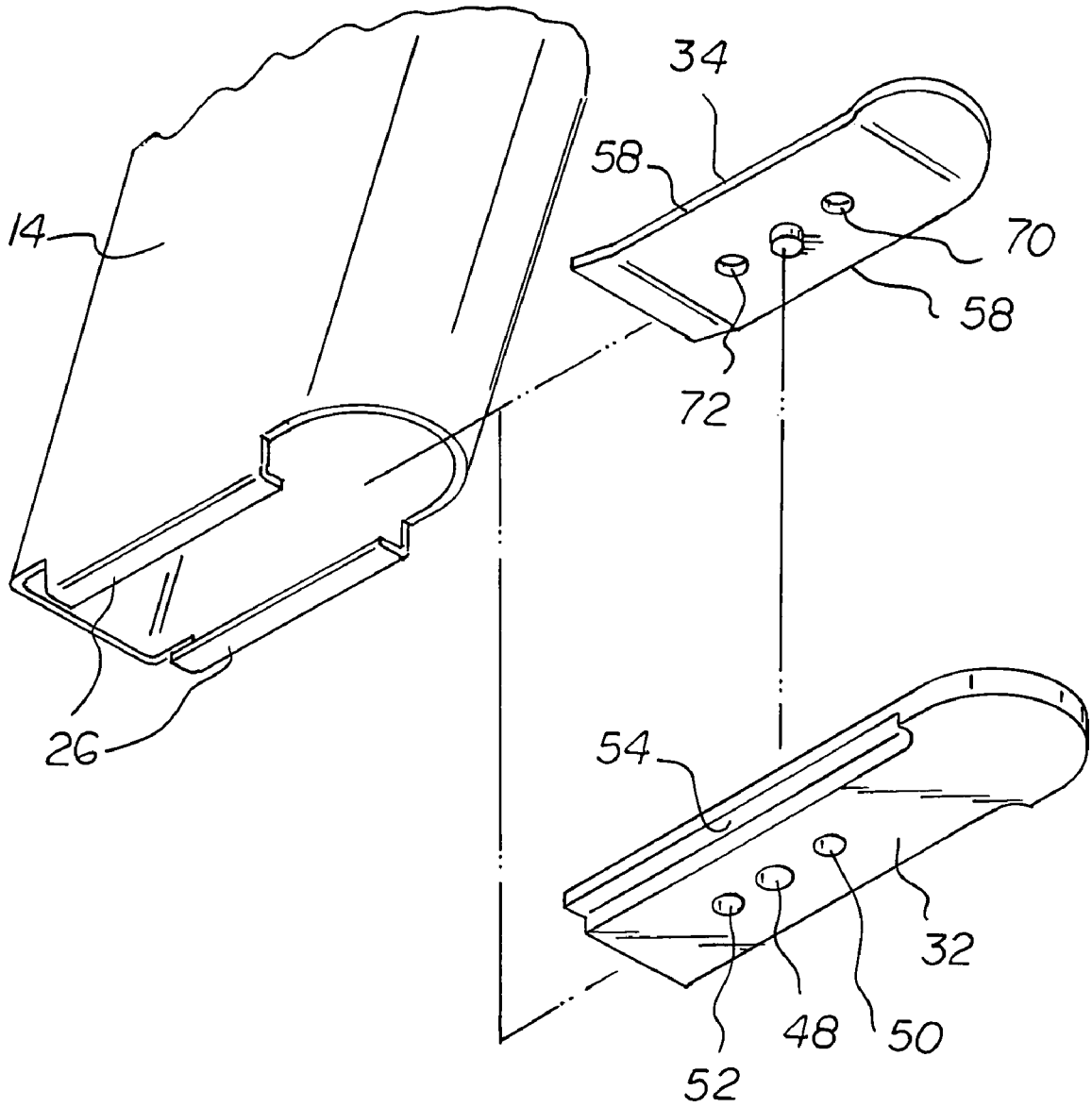
FIG. 7 is an exploded perspective illustration of the system of the prior Figures.

With reference now to the drawings, and in particular to FIG. 1 thereof, the preferred embodiment of the new and improved removable base magazine system embodying the principles and concepts of the present invention and generally designated by the reference numeral 10 will be described.

The present invention, the removable base magazine system 10 is comprised of a plurality of components. Such components in their broadest context include a removable base magazine, a base plate assembly and a resilient element. Such components are individually configured and correlated with respect to each other so as to attain the desired objective.

First provided is a removable base magazine 14. The magazine is in a rectilinear configuration. The magazine has an upper extent 16. The upper extent is positionable adjacent to a barrel. The magazine has a lower extent 18. The lower extent is positionable totally within a handle. The magazine also has rectangularly shaped large side faces 20 and rectangularly shaped small front and rear faces 22, 24. The front and rear faces couple the side faces. Inwardly flared flanges 26 are spaced beneath the lower extent of the side and front and rear faces. The magazine is adapted to receive bullets. The magazine is further adapted to be positioned within the magazine.

A base plate assembly 30 is provided. The base plate assembly has a relatively thick base plate 32. The base plate has a first thickness of about 0.80 inches. The base plate has a relatively thin retainer 34. The retainer has a second thickness of about 3/64 inches.

The base plate has a length of about 1.59 inches and a width of about 0.488 inches. The base plate has long essentially parallel side edges 38. The base plate has a flat rear edge 40 and a semi-circular front edge 42. The base plate has a top face 44 and a bottom face 46. A circular aperture 48 is provided in proximity to the center of the base plate. Forward and rearward apertures 50, 52 are provided forwardly and rearwardly of the circular aperture. The base plate also has linear recesses 54 on the bottom face adjacent to the side edges. The linear recesses extending from the rear edge to adjacent to the front edge. The recesses are adapted to receive the flanges of the side faces during operation and use.

The retainer has a length of about 1.32 inches and a width of about 0.483 inches. The retainer has long essentially parallel side edges 58, a flat rear edge 60 and a semi-circular front edge 62. The retainer has a top face 64 and a bottom face 66. A cylindrical projection 68 is provided. The projection has an axial length of about 0.06 inches. The projection extends downwardly from the bottom face through the circular aperture of the base plate for the coupling there between. The retainer has forward and rearward apertures 70, 72 forwardly and rearwardly of the cylindrical projection. The apertures are in axial alignment with the forward and rearward apertures of the base plate during operation and use. The rear edge of the retainer is located forwardly about 0.40 inches from the rear edge of the base plate. The rear and front edges of the retainer are curved upwardly from the base plate.

When the base plate assembly has its retainer positioned with its cylindrical projection extending downwardly into the circular aperture of the base plate, the assembly is slid into position at the bottom of the magazine. The rear edge of the retainer is held down by a user during the sliding of the assembly into position. When fully slid into position, the base plate is above the flanges and beneath the front and rear faces while the retainer is above the base plate between the front and read faces. It is held in position by the upwardly curved rear end of the base plate in contact with rear face of the magazine and upwardly curved front end of the base plate in contact with front face of the magazine. Separation of the assembly from the magazine requires the user to push the cylindrical projection upwardly out of the circular aperture where after the base plate my be slid out of the magazine.

The preferred material for the base plate and the retainer is a rigid metal selected from the class of rigid metals including carbon steel and 410 stainless steel.

Provided last is a resilient element 76. The resilient element is within the magazine. The resilient element is adapted to urge bullets within the magazine upwardly toward the barrel.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A removable base magazine system for use with a pistol of the type having a barrel and a trigger and a handle for fully receiving the removable base magazine system comprising, in combination:

a removable base magazine in a rectilinear configuration having an upper extent positionable adjacent to a barrel and a lower extent positionable totally within a handle, the magazine also having rectangularly shaped large side faces and rectangularly shaped small front and rear faces coupling the side faces and with inwardly flared flanges spaced beneath the lower extent of the side and front and rear faces, the magazine adapted to receive bullets and also adapted to be positioned within the magazine;

a base plate assembly having a relatively thick base plate with a first thickness of about 0.80 inches and a relatively thin retainer with a second thickness of about 3/64 inches;

the base plate having a length of about 1.59 inches and a width of about 0.488 inches with long essentially parallel side edges and a flat rear edge and a semi-circular front edge, the base plate having a top face and a bottom face with a circular aperture there through in proximity to the center thereof and with forward and rearward apertures forwardly and rearwardly of the circular aperture, the base plate also having linear recesses on the bottom face adjacent to the side edges extending from the rear edge to adjacent to the front edge, the recesses adapted to receive the flanges of the side faces during operation and use;

the retainer having a length of about 1.32 inches and a width of about 0.483 inches with long essentially parallel side edges and a flat rear edge and a semi-circular front edge, the retainer having a top face and a bottom face with a cylindrical projection having an axial length of about 0.06 inches extending downwardly from the bottom face through the circular aperture of the base plate for the coupling there between, the retainer having forward and rearward apertures forwardly and rearwardly of the cylindrical projection in axial alignment with the forward and rearward apertures of the base plate during operation and use, the rear edge of the retainer being located forwardly about 0.40 inches from the rear edge of the base plate with the rear and front edges of the retainer being curved upwardly from the base plate, the base plate being positionable above the flanges and beneath the front and rear faces while the retainer is positionable above the base plate between the front and read faces, the base plate and the retainer being fabricated of a rigid metal selected from the class of rigid metals including carbon steel and 410 stainless steel; and a resilient element within the magazine adapted to urge bullets within the magazine upwardly toward the barrel.

2. A removable base magazine system comprising:

a removable base magazine in a rectilinear configuration having side faces and front and rear faces and with inwardly flared flanges spaced beneath the lower extent of the side and front and rear faces;

a base plate assembly having a base plate and a retainer, the base plate having a top and a bottom and parallel side edges there between and a rear edge and a front edge with a circular aperture there through, each parallel side edge having a linear recess on the bottom of the side edge, the retainer having essentially parallel side edges and a rear edge and a front edge with a cylindrical projection extending downwardly from the bottom face through the circular aperture of the base plate for the coupling there between, with the rear and front edges of the retainer being curved upwardly from the base plate; and a resilient element within the magazine adapted to urge bullets within the magazine upwardly toward the barrel.

3. The system as set forth in claim 2 wherein the base plate is positionable above the flanges and beneath the front and rear faces while the retainer is positionable above the base plate between the front and reed rear faces.

4. The system as set forth in claim 2 wherein the base plate and the retainer are fabricated of a rigid metal selected from the class of rigid metals including carbon steel and 410 stainless steel.

* * * * *